US011080978B1

(12) United States Patent
Goldstein

(10) Patent No.: US 11,080,978 B1
(45) Date of Patent: Aug. 3, 2021

(54) VIRTUAL SAFE ENABLED WITH COUNTERMEASURES TO MITIGATE ACCESS OF CONTROLLED DEVICES OR SUBSTANCES

(71) Applicant: Steve Goldstein, Delray Beach, FL (US)

(72) Inventor: Steve Goldstein, Delray Beach, FL (US)

(73) Assignee: Intellishot Holdings Inc., Delray Beach, FL (US)

( * ) Notice: Subject to any disclaimer, the term of this patent is extended or adjusted under 35 U.S.C. 154(b) by 0 days.

(21) Appl. No.: 16/732,049

(22) Filed: Dec. 31, 2019

Related U.S. Application Data

(60) Provisional application No. 62/787,171, filed on Dec. 31, 2018.

(51) Int. Cl.
*G08B 15/00* (2006.01)
*G07C 9/37* (2020.01)
(Continued)

(52) U.S. Cl.
CPC ..... *G08B 15/005* (2013.01); *F41A 17/066* (2013.01); *G07C 9/37* (2020.01); *G08B 13/26* (2013.01)

(58) Field of Classification Search
CPC ..... G08B 15/005
See application file for complete search history.

(56) References Cited

U.S. PATENT DOCUMENTS

2003/0163709 A1* 8/2003 Milgramm ..... G07C 9/37 713/186
2006/0049938 A1* 3/2006 Wilson ..... G08B 7/06 340/541

(Continued)

*Primary Examiner* — Travis R Hunnings
(74) *Attorney, Agent, or Firm* — Darrin A. Auito; HEA Law PLLC

(57) ABSTRACT

A system and means of implementing and providing a virtual perimeter enabled with interactive countermeasures to mitigate accessibility of an area or object and includes at least one sensor that establishes an electronic virtual border from at least one point to define a space, digital detection electronics for detecting the presence of an individual, animal or object encroaching the virtual border and at least one countermeasure that impedes or thwarts the movement or actions of the detected individual, animal or object. The system provides for the data collection, authorization, and deploying of countermeasures and the reporting and storage of state for an electronic virtual or electronic safe that is created as a protected space within the digital domain and can be represented within any physical or virtual location wherein the virtual safe is digitally enabled to detect the presence of a human through impedance, optical, mechanical, chemical, electronical or acoustic measurements, enables a deterrent when the presence of a person is detected, disables the deterrent if it determines the person is white listed based on facial recognition, gate analysis or voice recognition technology, escalates the deterrent if the person is not authorized as they encroach the space to impede or thwart the threat and enables a shock wave or pulse when a protected item is approached or touched. The system is a contextually aware system that based on environment or location can change its performance, countermeasures and, or intensity of countermeasures and has multiple modalities in which countermeasures are activated.

50 Claims, 1 Drawing Sheet

(51) Int. Cl.
*G08B 13/26* (2006.01)
*F41A 17/06* (2006.01)

(56) References Cited

U.S. PATENT DOCUMENTS

| | | | | |
|---|---|---|---|---|
| 2006/0055534 | A1* | 3/2006 | Fergusson | G08B 13/26 340/562 |
| 2006/0248341 | A1* | 11/2006 | Lambert | G06F 21/32 713/182 |
| 2012/0222667 | A1* | 9/2012 | Vendramini | F24B 1/18 126/502 |
| 2015/0254948 | A1* | 9/2015 | Acosta | G08B 13/1895 340/541 |
| 2018/0122167 | A1* | 5/2018 | Maggioni | G07C 9/28 |
| 2018/0349589 | A1* | 12/2018 | Perna | G07C 9/37 |
| 2020/0003511 | A1* | 1/2020 | Deng | F41A 19/01 |
| 2020/0035052 | A1* | 1/2020 | Arnold | G07C 9/00571 |
| 2021/0020008 | A1* | 1/2021 | Deutsch | G08B 13/19684 |

* cited by examiner

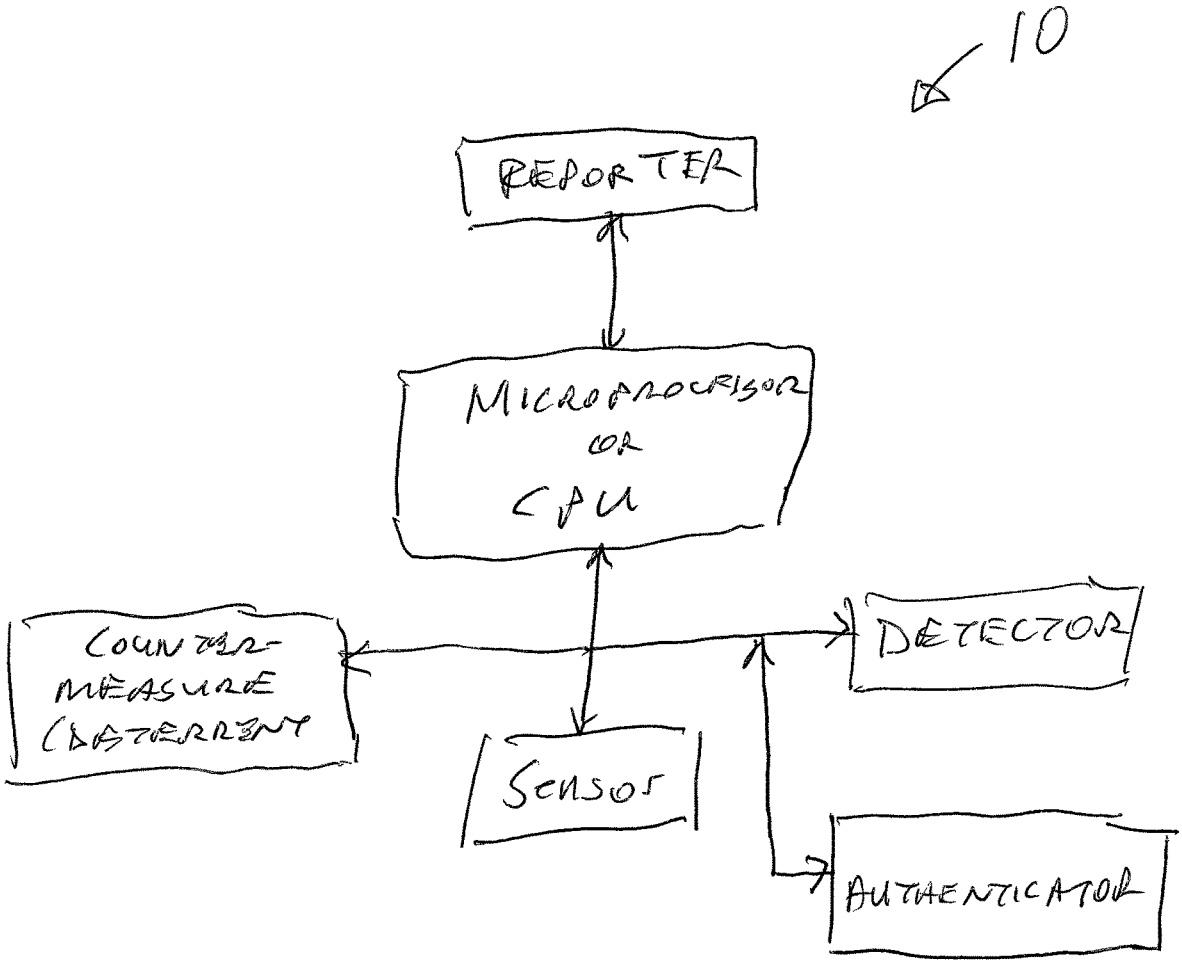
10
REPORTER
MICROPROCESSOR OR CPU
COUNTER-MEASURE CASTERRENT
DETECTOR
SENSOR
AUTHENTICATOR

VIRTUAL SAFE ENABLED WITH COUNTERMEASURES TO MITIGATE ACCESS OF CONTROLLED DEVICES OR SUBSTANCES

CROSS-REFERENCE TO RELATED APPLICATION

This application claims the benefit of provisional patent application Ser. No. 62/787,171 filed Dec. 31, 2018.

FIELD OF THE INVENTION

Embodiments of the system and methods described herein relate to the control and access of any product, device, vehicle, computer, document, valuable, currency, art, substance, nanoenergentic, RF energetic, chemical, organism, biological agent or radioactive material, non-human living organisms (animals), that may endanger one or more living things or loss of valuables by accessing it which by its very nature exposes and introduces the potential of loss to life, property or value coupled to a method and process to dissuade a user access if they are deemed to be unauthorized. The applications of the invention focus on industry sectors representing consumer, commercial, industrial, manufacturing, financial, precious metals & minerals industry, professional, medical, clinical, pharmaceutical, transportation, and government uses (military, law enforcement and other governmental agencies). More specifically, this invention focuses on authorizing access of a firearm, as well as the detection, alerting and deterring or neutralizing unauthorized users of access to a firearm.

BACKGROUND OF THE INVENTION

Technology may provide the answers in the quest to resolve one of our nation's most controversial societal issues: theft of property as a result of breakins, gun violence and the harm caused by these crimes. As one example, in the past decade, over one million Americans have been shot, and approximately 31,000 people are killed each year by firearms. That rate is nearly 20 times greater than other industrialized countries. In order to reduce the harm caused by the widespread use of guns, various technological solutions have been proposed. Moreover, easy access to firearms enables the unintended discharge by youths and others who aren't trained in weapon safety causing thousands of accidental shootings every year.

Each year in the US alone approximately 900 teenagers take their own life with a firearm and cause thousands of unintended shootings. The Center for Disease control reports indicate at 84% of those suicides makes use of the parents' gun or someone they know. Finally, the epidemic shootings taking place at our nation's schools have now reached over 600 children that have been shot or killed since the Sandy Hook tragedies. Of these shootings, over 67% used their parents' gun. It become clear that access to a weapon by an unauthorized user is the critical element of the calculus in order to mitigate these tragedies and improve safety.

One potentially disruptive solution that has been introduced is what is termed "Smart guns". Smart guns operate in a variety of ways to prevent the trigger from being fully deployed when someone other than the owner tries to use them. Some utilize a four-digit password like a Smartphone; others incorporate a form of biometric validation (grip, fingerprint, etc.).

However, there are of course complicating factors. Most significantly, various pro-gun rights lobbyists and organizations have been outspoken against the adaption of smart gun technology, as they believe the digital orientation of such devices could lead to a national registry of gun owners and increase the likelihood of government confiscation. Complicating matters, some gun owners are concerned about reliability to fire the weapon, even though extensive testing has shown these technologies offer a high degree of reliability in most cases. All in all, adoption of these new technologies may encounter $2^{nd}$ amendment concerns, and thus smart gun technology has experienced little acceptance and uptake.

One reason smart firearms are struggling to be embraced is that even the most basic firearm weapon is built to operate for decades and without failure. Estimates indicate there are roughly 400+ million firearms currently in circulation, enough for every man, woman and child in the US. The clear majority of gun owners do not see the need to replace their existing firearms based on a goal of improving safety alone. In fact, they typically keep ownership of their firearms for decades, as guns last almost indefinitely. Furthermore, over 47% of gun owners choose not to keep their weapon stored in as safe, as they believe they need immediate access to the weapon in order to protect their family and further believe their children don't know where the weapon is hidden, and even if they found it, they wouldn't touch it. Finally, Smart gun technology offers little value to mitigate gun violence if the gun owner desires a lethal outcome of an encounter or use of the weapon.

Assuming for the moment, that there was unanimous support for using Smart gun technology, at the current rate of 3.6 million annual sales of firearms, it would take approximately 110 years to replace the existing inventory that resides across America's homes. Thus, replacing current firearms with some type of digitally enablement may require the passage of decades to be fully realized.

Availability of firearms. To better understand the societal imperative for the need of the invention disclosed, let's consider the weapons that are purchase for home protection. In the US alone, sales of handguns average about 9 million units sold annually. Of that number, approximately, 80% purchase handguns for home defense applications. Thus, 7.2 million handguns are purchased annually for home defense and the vast majority are brought into the home, specifically the bedroom. Today, one in three homes have a child and weapon in the same physical environment. In general, 47% of the gun owners choose not to store their weapons in a safe either for reasons of quick accessibility or listlessness. Consequently, this is a recipe for unintended consequences, as these weapons become instruments of destruction based on accessibility by teens that wish to do harm to themselves or other, as well as these who shoot themselves or others through unintentional acts. There is still another group of individuals known as bad actors perpetrating home theft. These can take the form of professionals or friends of one's children scouring the parents' bedroom for drugs, cash and jewelry. All of these bad actors have one thing in common; it's the easy access to the firearm by unauthorized individuals. Embodiments of the invention are directed toward solving these and other problems individually and collectively.

SUMMARY

The terms "invention," "the invention," "this invention" and "the present invention" as used herein are intended to refer broadly to all of the subject matter described in this document and to the claims. Statements containing these terms should be understood not to limit the subject matter described herein or to limit the meaning or scope of the claims. Embodiments of the invention covered by this patent are defined by the claims and not by this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, to any or all drawings, and to each claim.

The instant invention is a system and means of implementing and providing a contextually aware virtual perimeter enabled with interactive countermeasures to mitigate accessibility of an area, object or of any product, device, vehicle, computer, document, valuable, currency, art, substance, nanoenergentic, RF energetic, chemical, organism, biological agent or radioactive material, non-human living organisms (animals), and includes at least one sensor that establishes an electronic virtual border from at least one point to define a space, digital detection electronics for detecting the presence of an individual, animal or object encroaching the virtual border and countermeasure electronics for generating a countermeasure signal that impedes or thwarts the movement or actions of the detected individual, animal or object. The invention also includes authentication electronics for determining whether the individual, animal, object or any product, device, vehicle, computer, document, valuable, currency, art, substance, nanoenergentic, RF energetic, chemical, organism, biological agent or radioactive material, non-human living organisms (animals), is authorized for access to the space and countermeasure disabling rights for disabling the countermeasure electronics when the person, animal or object is authenticated for access to the space. As an example, the invention provides a system and means for implementing an intelligent and nonpartisan approach to limit gun violence, enhance gun safety, and reduce suicide, crime, and accidental shootings. Embodiments of the system and methods described herein provide for the data collection, authorization, deployment of countermeasures, electronic reporting and viewing, data recording for establishing a forensic trail and the reporting of state for an electronic Virtual Safe (virtual-safe meaning that the safe that is created is a space within the digital domain and can be represented within any physical or virtual location); as it is believed that this approach will yield the most favorable reception to the ever-rising gun violence issue and without political conflict being an ingredient. In this regard, the described "Virtual Safe" is digitally enabled; with no replacement firearm technology required for it to operate nor is there any modification to the firearm required. The virtual Safe is a freestanding set of technologies, which influence accessibility to the weapon and other devices.

BRIEF DESCRIPTION OF THE DRAWINGS

FIG. 1 is a block diagram of the virtual safe enabled with countermeasures to mitigate access of controlled devices or substances system of the instant invention.

DETAILED DESCRIPTION OF THE INVENTION

Embodiments of the invention are directed to systems, apparatuses, and methods for the detection and contextually aware monitoring of a physical or virtual region or space to be protected, and a means to the authentication of a device such as the weapon, or its accessories, including a magazine, ammunitions, documentation and a means to manage, influence and to deter or neutralize the users access to these devices by deploying countermeasures. In some implementations and embodiments, contextually aware detection and monitoring can include Real Time Location System (RTLS) monitoring of the Virtual Safe and its associated contents for a defined area called the Region of Interest or the protected space. The space can be enabled by an electronic virtual border around a single point with a predefined set of boundaries, such as geofencing or computer vision. Or, the tracking of a physical safe, weapon and its contents may utilize RF transceivers or magnetic transceivers, acoustic transceivers or other whereas the safe (physical or virtual), weapon and its contents include internal or external sensors for determining location, speed of movement, heading, vibration, acceleration (e.g., 3D acceleration), or other information that can monitor the activity, state, identification of the safe, weapon and its contents to provide detection and contextual awareness. Accessing of the control system can be accomplished mechanically with a key, combination lock or electronically with a password or a biometric interface.

The Protected Space—(also identified as Zone 0 (zero)) is a subspace within the Facility, with boundaries defined by either a simple radius from the center of the protected space (a spherical protection zone), or by a more complex set of three-dimensional boundaries. The boundaries of the protected space, may, but need not, correspond to and coincide with the boundaries of an object or physically defined space. That is, the boundaries of the protected space, may be the same as the sides of a physical box or enclosure (e.g., a traditional lock box or safe or drawer), in which case the physical enclosure may form part of the overall virtual Safe system. This configuration (i.e., incorporating a physical box) would allow, for example, the deployment of a wider range of interventions or countermeasures, and each individual intervention or countermeasure may not need to be as robust. However, there are other tradeoffs with this configuration, such as potentially slower access to the contents of the protected space, by authorized individuals. Thus, for maximum flexibility of configuration and deployment, the presence of a physical enclosure is not required, and the protected space, may be defined via a set of purely virtual boundaries.

These boundaries for the protected space may be defined manually via a user interface, or automatically by the system. The user interface to manually configure the protected space and its boundaries includes a graphical user interface (GUI), and a speech user interface. Users interact with a rendering of the facility, and select boundary points, planes, and/or radius. To automatically define the protected space, the system interrogates the facility model, and generates a protected space that considers facility constraints such as walls, floors, and ceilings. For example, the system may generate a 2-meter cube around the center of the protected space, then trim out invalid portions of the cube that fall outside a wall, or below a floor. This avoids the "thin wall problem" that is common in tracked spaces, namely the situation where a person might be only 1 meter away from the center of the protected space (thus seemingly inside the protected space), but actually be in the adjacent room, on the other side of a wall. That individual will not be considered a threat to the protected space, because the invalid portions of the protected space have been automatically trimmed/adjusted.

In addition to the boundaries of the protected space, a series of additional boundaries are defined, so as to create regions of space ("Buffer Zones") outside the protected space. The buffer zone closest to (contiguous with) the protected space is identified as Zone 1; the next distal region is identified as Zone 2; and so on for subsequent zones. There is at least one zone outside the protected space (Zone 1), and there may be arbitrarily many zones identified, numbered 1, 2, 3 . . . N. The boundaries of the Zones 1 . . . N may be identified manually via a user interface, or automatically by the system. If the zone boundaries are defined automatically, the system defines a radius of closest approach, meaning the minimum distance from any boundary of the protected zone, then either creates a sphere of that radius, centered on the protected zone, or mimics the boundary planes of the protected zone to create a similarly-shaped Zone 1, with larger dimensions. For example, the system could create a protected zone of 2 cubic meters, then create a Zone 1 boundary defined by a 3-meter cube (i.e., a 1-meter standoff from the protected zone). The boundaries of the automatically-defined Zones 1 . . . N are trimmed by interrogating the facility model for invalid portions of the protected space, as described in the creation of the protected space.

The automated generation of the protected zone and the subsequent buffer zones also leverage knowledge of the space, its purpose, likely inhabitants and activities, and the types of contents to be stored in the protected space. A database of previously configured/established-protected spaces is continually updated, including data from local facility as well as a network of protected spaces at other facilities.

The administrator can set up one protected space, then save those settings and replicate them with a second or subsequent protected space. The system can also automatically configure the protected space (and buffer zones) by comparing the local features of the facility model to features in the database of protected spaces obtained through the network of protected spaces and facilities. The features of the space that are used to automatically configure the protected space and buffer zones include, but are not limited to, facility category (e.g., medical clinic versus private home), protected storage type or purpose (e.g., medicine storage facility versus homeowner's bedroom nightstand), typical occupants (e.g., medical staff versus family members), and storage contents (e.g., opioid medicine versus handgun). The shape and size of the protected zone and the buffer zones can be automatically configured using information from the facility model and the database of prior configurations.

The system can also automatically configure the protected space and buffer zones by sensing the contents of the space. For example, sensors including but not limited to ToF detectors, CCD cameras, LIDAR, or ultrasound identify a room as being a bedroom, with a bed and a nightstand, and automatically configure a 0.5×0.5×0.5 meter protected space on one of the nightstands. Given that the facility is a bedroom, the system automatically sets the buffer zone sizes and shapes based on the database of rooms, typical traffic patterns in such a room, the typical occupants of that room (including, for example, the homeowners who sleep in that room, plus children who may also enter the room).

The system is also able to monitor the protected space and/or buffer zones, and automatically adjust boundaries based on changes to the facility model or changes in the area around the protected space. For example, if sensors identify that the bed has been moved to a new place in the room, so the boundaries of the protected space on the nightstand, and the buffer zones, are automatically adjusted accordingly. Or, for example, if more traffic is detected in the area around the protected space, the boundaries of the protected space and/or buffer zones can be adjusted. Any of these changes may be based on periodic reassessment of the space, up to and including real-time dynamic adjustments.

The system can also automatically configure or reconfigure the protected space and/or buffer zones based on the contents of the facility. For example, if a wristwatch is identified on the nightstand, the system can configure the protected space to be 0.5 cubic meter and buffer zones to increase by 0.5 meter. However, if a handgun is identified on the nightstand, the system would typically configure the protected space and buffer zones to be larger, in anticipation of a higher-value item requiring a more vigorous defense. The reconfiguration of the protected space and/or buffer zones can be done dynamically such that if the contents of the facility change, the configuration will also change accordingly. For example, if there is a protected space on top of the nightstand, and a wristwatch identified in the protected space, then an authorized user places a handgun on the nightstand beside the wristwatch, and then the system will dynamically adjust or reconfigure the protected space and/or buffer zones (e.g., make the buffer zones larger).

In addition to the shapes and sizes of the protected space and buffer zones, the system configuration includes the intervention that will be directed at any threat that enters the buffer zone or protected space. The mapping of intervention to zone (i.e., what intervention is applied or triggered, when an intruder enters Zone 3, then Zone 2, then Zone 1) may be configured manually via a user interface, or automatically by the system. Automatic configuration of the interventions leverages the data and processes described above, including but not limited to the database of previous installations; dynamic changes to the facility, occupants, movement, etc.; or identification of the contents of the facility. For example, the intervention associated with breaching the boundary of Zone 2 would typically be more aggressive (more noxious, aversive) if there were a handgun in the protected space than if there were a wristwatch.

Countermeasures—a method and process to impact access of the item that is being monitored within a physical location or virtual set of boundaries. This includes (Taxonomy) impeding, obstructing, disrupting or terminating access by deterring, neutralizing, preventing or protecting. Countermeasures serve to deter the individual, either for a short period in the order of a 300-400 milliseconds or longer acting countermeasures, which can induce effects in the order of minutes or hours. Countermeasures include non-lethal or less than lethal measures, which can be delivered in a series of escalating steps or other patterns. In one embodiment countermeasures serve to cause the sensation of fight or flight. In one embodiment, the initial deployment phase of the countermeasures can begin as an Acoustic Startle Reflex. The startle acoustic reflex is thought to be caused by an auditory stimulus greater than 120 decibels coupled with the fast rise time of the initial excitation of the acoustic transducer.

There are many brain structures and pathways thought to be involved in the acoustic reflex. The amygdala is known to have a role in the fight or flight response, and the hippocampus functions to form memories of the stimulus and the emotions. It elicits a reflexive startle response, which is an unconscious defensive response to sudden or threatening stimuli. The gross physical manifestations of startle include a forward thrusting of the head and a descending flexor wave reaction that extends through the trunk to the knees. The reflexive episode is exhibited for approximately 400 milliseconds, during this period; the individual is momentarily stunned or shuttered thereby temporally impeding with their original plan of accessing the weapon as an example.

Following the initial phase of the countermeasure, the next deployment phase can begin in a sequential manner as to produce sound pressure levels of 140 dB, thereby inducing the Threshold of Pain. The Threshold of Pain is the sound pressure level beyond which sound becomes unbearable for a human listener. This threshold varies only slightly with frequency.

Prolonged exposure to sound pressure levels in excess of the threshold of pain can cause physical damage, potentially leading to hearing impairment. In order to ensure the safety of one hearing, an acoustic transducer array operatively coupled calibrates the maximum SPL level for a given room size. This calibration procedure can take place at installation or other times. A built-in DSP circuit and hardware monitors the sound pressure levels dosages being delivered by the excitation of the acoustic transducers in the area being covered, thus ensuring that OSHA and NIOSH guidelines are respected and that the acoustical array does not induce a temporary threshold shift or permanent threshold shift. A temporary threshold shift is a temporary shift in the auditory threshold resulting in temporary hearing loss sometimes including temporary tinnitus, where as permanent thresholds shift is a permanent loss of hearing. It can occur suddenly after exposure to a high level of noise.

The duration of the excitation episode can be as short as a few seconds up to minutes for more based on the coverage size, the location that the transducers are located and the distance that individual is from the transducers. The acoustical energy can be a pure tone or a complex tone with a composed of spectral and temporal features.

Incremental Intervention (aka Countermeasures)—Under the design policy of Incremental Intervention, there are more severe or adverse interventions (also known as countermeasures) deployed to zones that are closer to the protected space. This allows for the design of a set of incremental interventions that include low-level alert(s), followed by mid-level warning(s), then pre-emptive moderate interventions, and then full-scale interventions. For example, a non-verbal audio chirp can be associated with Zone 4, such that when a person enters that zone the chirp alert is played; entering Zone 3 could trigger a recorded voice saying "Restricted zone"; entering Zone 2 could then result in a brief but loud deterrence sound, plus a louder verbal recording of "Step Back!" entering Zone 1 would trigger a complete full-volume blast of deterrence audio, stroboscopic light, and electric shock. As described above, the specific interventions mapped onto the zones can be manually or automatically assigned, and may also be dynamically adjusted or reconfigured. The data used to adjust the interventions can also depend on the specific nature of the threat. For example, a young child wandering into the parents' bedroom and slowly approaching the area of the nightstand warrants a different zone configuration and intervention mapping than does an unidentified adult walking quickly into the bedroom and heading directly for the gun on the nightstand.

Audio Elements of System

In each of the various phases of system operation (i.e., learning, monitoring, threat detection, adverse incident identification, and intervention, audio may be utilized by the system. In this document, the term audio refers broadly and inclusively to any combination of the generation, transmission, or detection of vibrational energy. This may certainly include, but is not limited to, uses of audible sounds such as, for example, the creation of an audible warning sound that is played via a loudspeaker; or the detection of the characteristic sound of a gunshot; or the transmission of a very loud sound directed at a perpetrator. However, the use of many other types of audio is also contemplated, not limited to audible sounds. This may include, but are not limited to, the generation, transmission, or detection of ultrasound (vibrational energy at frequencies greater than the typical perceptual range of human hearing), or of infrasound (vibrational energy at frequencies lower than the typical perceptual range of human hearing; these sounds may still be "felt" by a human). Vibrational energy utilized by the system may be transmitted through any available substance or medium, including but not limited to, air, water, building materials, or body tissues. Audio used by the system may be of any duration or durations; any frequency or any combination or pattern of frequencies; at any location or locations near to or within the facility.

Overview of the Virtual-Safe Hardware and Processing

The Virtual Safe system is comprised of six primary elements. The first element—is a multi-instrumented fusion detector [Inertial Measurement Unit (IMU)] that incorporates an accelerometer, gyroscope and magnetometer into a 3D space orientation sensor which can reside in the body of a physical safe, inside a physical space, outside of physical science, or a space that is defined by a virtual set of boundaries. The IMU can be attached to its surface, or a revolver handle attached to revolver in a magazine or clip attached or attached to its body. The IMU is coupled to a power source and transceiver which monitors the IMU's location, precise movement, power level, distance moved, speed of movement, activity, axis, zenith, duration, time of event, and reports this information to a receiving circuit that is within range of the RF, MI, or BT broadcast area. The IMU engine provides immediate status update, as such, it is used to active other elements of the system as needed. Alternatively, a RFID, Magnetic Induction or Bluetooth, or other enabled wireless sensor maybe installed on or in the weapon, or magazine, where its movement can be discerned using computational information from signal strength data known as our RSSI. Furthermore, a BT Beacon platform can be used as well other wireless signal strength technologies.

The second element of the virtual safe system—is acoustical transducer, which is used to produce acoustic stimuli in the band of infrasonic, sonic, and ultrasonic information and serves as a countermeasure. The transducers can take the form of a piezo, hypersonic, electrostatic. The acoustic stimuli can take the form of words, full sentences in any language, music, tones, spectral and temporal modulated sounds including as an example a Shepard tone, all of which can be produced at sound pressure levels that exceed the threshold of pain. In addition, the acoustic transducer enclosure contains a transceiver, which communicates with the IMU, and other peripheral such as the IMU and the other components of the virtual safe system. The transceiver can be mounted elsewhere. Furthermore, its interoperability communicates its status via with police fire safety as well as security companies or other monitoring services, in addition it can communicate via SMS, BT or to a web server.

The third element is—Machine Vision using a Time of Flight Camera: The embedded system incorporates machine vision, which enables for example: the physical and motions of humans such as detecting if there are any suspicious changes in their behavior or unusual movements. As an illustration, an individual is electronically captured walking back and forth in a certain area over and over indicating casing the area for a future crime. Another example, their body position and stance are analyzed to determine threatening patterns. Further, the system can detect and report anomalous object detection of a package or knapsack, emotion recognition. In another enablement, machine vision can track by clothing type, clothing, human weigh, height, hair length facial emotion, gate, and body pose as well as ethic background. These are examples of current detection capability; though the invention disclosed incorporates other non-vision based detectors. As an example, the system is capable of interfacing with a broad variety of weapon detection techniques including RF, X-Ray, and Magnetic, Object Recognition Chemical detection methodology.

The method and process disclosed creates unsupervised awareness, spots incursions and anomalies for advanced threat tracking and assessment, identifies and classifies individuals, identifies individuals of interest and enables situational awareness, detect potential threats, conducts virtual screening while maintaining traffic flow and intelligence.

The environment in which the system functions contains one or more sensors and a threat and response engine. Using the Neural networks, Machine vision and incorporates Deep Learning The system monitors the environment and distinguishes a level of threat based on behavior, feature of movements or the criteria. The system can also leverage sonic signatures, SPL levels, words detection to detect threats. Detectors include a vision enabled platform which enables Pixel processing, Neural processing, advanced vision processing, a microphone array to enable auditory scene analysis, and blind source separation are elements of this invention for a multilayered security advanced threat detection and prevention platform combining multiple sensors, artificial intelligence, provides for a proactive, real-time approach to security that can learn and adapt quickly to emerging threats.

More specially, Computer Vision system, serving as a vision sensor and providing high-level information about the environment and the inhabitants and objects placed within the environment. Other components of the system which belong to artificial intelligence include machine learning and software embedded as a Computer Vision Engine In totality, the (CVE) is used in relation to computer vision is pattern recognition, and learning techniques including: Image Classification, Object Detection, Object Tracking, Semantic Segmentation and Instance Segmentation.

There can be any number of detection elements or nodes in a given area used for detection and analysis. In one embodiment of the invention, we disclose the use of a Time of Flight camera: 3D Time-of-Flight (ToF) technology is revolutionizing the machine vision industry by providing 3D imaging using a low-cost CMOS pixel array together with an active modulated light source. A 3D time-of-flight (ToF) camera works by illuminating the scene with a modulated light source, and observing the reflected light. The phase shift between the illumination and the reflection is measured and translated to distance. Typically, the illumination is provided by a solid-state laser or a LED operating in the near-infrared range (~850 nm) invisible to the human eyes. An imaging sensor designed to respond to the same spectrum receives the light and converts the photonic energy to electrical current. Entry-level ToF technology functions well up to about 10 meters, which make this technology ideal for a bedroom or office applications. More powerful ToF cameras are available that can be used for far field conditions up to 250 meters.

A number of computer vision detection modalities can be enabled using specific detectors, such as LIDAR, RADAR, visible, infrared, and hyperspectral, thermal imaging, for night vision and thermal and fire detection, low-visibility imagining detectors for use when smoke or for is present, detectors containing laser rangefinder (LRF) or Ultrasound Sensors, Sonar Sensors and Ultrasound Sensors.

During installation or other times as required, the IMU embedded in the Safe Lockbox, Safe magazine, as well as the SafePad or other locations transmit a signal defining its coordinates within the facility. The computer vision engine automatically creates a boundary area, which is proportionally larger and potentially different than the boundary defined by the IMU boundary. This is known as the Safety Zone.

During installation, the computer vision engine using data produced by the ToF camera in real time creates graphics representing the region of interest or Protected space and superimposes a secondary boundary layer called the Buffer zone. In one embodiment, the ToF detector and lens can be mechanically or electronically aligned and tuned to achieve the coverage requirements of the region of interest protection suggested by the graphic produced.

In one embodiment, a small pan/tilt/rotation motor mounted to the [ToF camera, or electronically by an adaptive optics system, using a deformable mirror, can achieve optimizing coverage. In one embodiment, the near IR vertical-cavity surface-emitting laser (VCSEL) is also adjustable using the same solutions enabled for the ToF camera.

In one embodiment, the ToF system, communicates with the entire system. It detects, analyses and enables the system to perform its holistic function which are detailed below:

In another embodiment, the built-in microphone array can be used to localize noises such as footsteps, coughing, spoken words, artifacts such as a flashlight been dropped for the purpose of assessing the location our user maybe located in particular moment in time. The acoustic directionality information could align the ToF camera or other detector and follow the individual within a given facility. Using more than one ToF camera, and more than one microphone array, the user can be tracked from the point of entry the point of exit of the facility.

In one embodiment, the buffer zone is used to minimize false positives as such, is the use case when someone enters the buffer zone doesn't want to alert to system. In addition, the ToF viewing area data can be seen presented to a mobile phone or other computer screen, the screen interface enables the administrator to define a virtual space along with objects to be included or exclude from the buffer zone. In one example, the Protected space could be in proximity of a common walkway where the gun owner or their spouse may be walking passed the buffer zone to a bathroom multiple times during the day and a door is ajar in the region of interest could accidently set off the alarm. This path could be outlined on a screen and removed is a false trigger.

In another embodiment, users may be blacklisted or whitelisted using biometrics such as gate, facial recognition, ear recognition, iris recognition or other. Using these approaches, an individual disturbing the protected space would be detected by the IMU and the countermeasure would be deployed hadn't previously authorized access. To prevent this from occurring, computer vision engine detects the presence in the buffer zone overlapping the protected space, and where by biometric recognition is performed by the computer vision engine, authenticating access to be granted as they individual is white listed. In this scenario the countermeasure would not be deployed.

In one embodiment, the CVE operates in an always-on state and reports specific activity. As an example, it can distinguish between people, pets, toys and keys. It can recognize faces, gender and predict age. The CVE determines if there is someone inside the Buffer zone or Protected area that it doesn't recognize. As an example, it can send a notification along with an image to the administrator or other. It also recognizes simple sentences using the built-in microphone array, as to active or deactivates the virtual safe.

In one embodiment, it is capable of registering users whose identity needs to be confined (whitelisted). In another embodiment, the pet that constantly is setting off this system because it meanders into the Buffer zone can be easily whitelisted same way our human face be whitelisted. The embedded CVE system can accomplish this on a one-off basis as the administrator has access to the registration services.

In another embodiment, the face, and other features of individuals who are by acquired by the ToF camera along with a date stamp and GPS location can be sent to the administrator for bulk whitelisting based on manual or automatic validation.

In another embodiment facial recognition can do used to scan other databases for the identity of the individual. These databases can be private or public. The ToF CVE can send live video out as well. Currently, ToF offers a confidence detection rate (95.3%), clearly valuable to help mitigate false positives triggers along with unnecessary triggering of a countermeasure. This confidence level of identity affirmation is sufficient of a predefined Buffer zone.

The CVE could be used to assess effectiveness of the delivered countermeasure. In one embodiment, assuming the countermeasure were acoustic, the CVE would convey if the not-authorized individual had left the room, or buffer zone and if, are they carrying a weapon in their hand or other contents they didn't walk into the room with. In another embodiment, if the countermeasure were electrical stimulation, the CVE could detect the physical movements and sounds of the non-authorized individual after they've received an initial payload of electrical stimulation. The CVE can assess if the user is wearing gloves and or earplugs, which could compromise the effectiveness of the countermeasure. Thus, the system could alert the administrator that police or other should be called to intervene or deploy countermeasures that would provide the intended deterrent goal.

The fourth element of the Virtual Safe system—Audio Feature Detection. Detection of the presence (or absence) of a particular kind of audio feature or audio signal characteristic may be evidence of a potential threat. The system monitors the audio signals, processes them to identify acoustic features, and compares those features to templates and samples in a database of sound features, in order to identify potential threats to the facility.

Audio identification: The identification of the audio associated with a specific kind of source or object or activity or event may provide evidence of a potential threat. For example, potential threats may be signaled by the sound of a gunshot; or the sound of the chambering of bullet in a gun; or smashed glass. The system monitors the audio signals, processes them to identify specific characteristic sounds, and determines if any identified sounds indicate potential threats.

Audio localization: The location of a static audio source, or the direction of movement of a dynamic audio source may provide evidence of a potential threat, or may also contribute to the response to an adverse event. For example, an array of sensors may be able to determine the location from which a bullet was shot. Or the direction that a person is running may be determined by the combined pattern of the sound of footfalls and structural vibrations. The system monitors the audio signals, processes them to identify the locations and spatial characteristics of sounds, and determines if any identified sounds indicate potential threats.

Human audio: Audio (largely audible sounds but possibly all kinds of audio) that are produced by humans may provide evidence of a potential threat. For example, the sound of screams, gasps, or yells may indicate a threat to the facility. As another example, ultrasound or infrasound can remotely detect heartbeats and therefore may detect elevated heartbeats, which in a specific time and location may provide evidence of a potential threat or of an adverse event. The system monitors the audio signals, processes them to identify human audio, and determines if any identified sounds indicate potential threats to the facility.

Audio for individual identification: Audio may be used by the system to identify a specific individual or individuals, which may be of use to the system directly, or may be used by the system to provide evidence for a threat. For example, voice sounds (spoken words) may be used to identify a speaker as a specific intruder. Or, audio from footfalls may be used in a gait analysis to assess the load an individual is carrying, or whether a limp is suspected. Or audio associated with a heartbeat may be used as part of an individual identification process. The system is train to understand the users voices in the facilities that come in contact with the microphone array, these users can be waitlisted or blacklisted. Further, audio may be used to assess the current state of an individual. For example, voice analysis may indicate level of stress of the individual, especially if an existing archived speech sample were available for reference. Thus, the system monitors the audio signals for human audio, and processes the human audio in order to identify individuals, identify current characteristics of individuals, and determine if any individuals may be a threat to the facility.

Word detection: Detection and recognition of the audio associated with utterance of a specific spoken word from a set of known words (e.g., recognizing the word "firearm" at a home) may provide evidence of a potential threat. Other examples may include "fire!", "run!" or "hide!", or "gun!". A facility codeword (or code phrase; see next) may also be detected, and understood as evidence of a threat. The system monitors the audio signals for speech, analyzes the speech signals, determines if specific words are detected, and if those words indicate a potential threat to the facility.

Speech comprehension: Detection and recognition of the audio associated with the utterance of a longer segment of speech, such as a phrase or sentence, may provide evidence of a potential threat. As an example, recognizing the phrase, "Everybody get on the floor!" may be a threat in a home intruder (but perhaps not in a dance club). The system monitors the audio signals for speech, analyzes the speech signals, determines if specific phrases are detected, and if those phrases indicate a potential threat to the facility based in part on the type of categories such as a dance club vs. a church.

Audio and non-threats: In addition to providing evidence of a potential threat or an adverse event, audio may be used by the system to provide evidence of some other status or event. For example, each of the categories/uses of audio described above may also be used to gather evidence of the lack of a threat, or the end or lack of an adverse event. For example, identification of the presence of a minister in a church, and the determination that the stress level for that individual is not elevated, and the recognition of the words, "All clear" may indicate a lack of a threat. Thus, the system monitors the audio signals, analyzes them, and either separately or in conjunction with other information (as described above) identifies other non-threat states and statuses for the facility.

The fifth element of the Virtual Safe system—A Non-lethal electrical shock to cause a deterrent: An electrical stimulus could be used as a countermeasure. The objective is to induce a non-lethal electrical shock as to cause a countermeasure that can be used to inflict a painful electric shock by the individual touching a set of electrodes. More specifically, the stimuli engine leverages neuromuscular electrical stimulation (NMES) for the elicitation of muscle contractions using electric impulses. The impulse waveform is generated by a small battery powered engine and is delivered to the human through the skin closest to the muscles targeted for contraction.

In one embodiment, this produces sufficient energy to prevent someone from handling up the weapon, tampering with the safe, moving the magazine, or attempting to insert a key or tumbler in a safe, or by activation by some other triggering mechanism and serves as to induce this countermeasure. Electrical Stimuli Engine (ESE) is powered by an internal battery using a setup transformer or other. The amount of energy produced by the electrical stimuli engine is within safe levels, yet sufficient to cause immediate recoil of one's hand that would touch the surface of the energized material. This is initiated by insights generated from the IMU, or by computer vision system including the ToF engine. Additionally, the control of the electrical stimuli engine can be remotely operated. The electrical stimuli engine can be installed in a gun, in a magazine, in a safe in a lockbox, and in any area or for which an electrical discharge can be enabled.

Based on human factors engineering together with the mechanical engineering, the electrical stimuli engine package is designed and installed to ensure electrical stun capabilities are achievable via two areas of contact on a single hand. This package can take on various form factors including a lockbox, a doorknob, and a lock tumbler knob. The design ensures that the shock path does not follow the coronary path across the body that another limb, including the opposite hand or either leg. This ensures that the shock is limited to only one hand. The shock power can be triturated based on the level of response required to thwart continued movement of the device. The electrical stimuli engine can be activated by the movements of the IMU, or control from other peripherals or from an app, SMS or web server or Computer Vision Engine.

There are use cases when electrical stimuli engine countermeasure type could serve as the optimum deterrent. Once such use case is where a virtual safe is located outdoors in open spaces and an acoustical stimuli countermeasure would not be effective due to attenuation of sound in an open area air environment and the power loss equation of dropping the level by 6 dB per doubling of distance. In addition, utilizing electrical stimulus enables the goal of maintaining a stealth profile.

In one embodiment knowing who is approaching and how they are prepared such as wearing headphones or gloves, determine age, described by the TOF can be used to enable the optimum countermeasure.

The disclosed solution is designed to induce pain or even involuntary muscular response using an electrical stimulus. The key factors when considering deterrence using electrical shock is safety; more specifically inducing the possibility of cardiac arrest. The system must be designed to ensure the shock path doesn't travel down the legs nor across the body to another limb. The shock path must be localized to the one hand and must be monitored for the exposure of energy it induces.

There are a number of novel inventions disclosed to achieve this goal; one is based on human factors interaction with the manipulation of the safe.

Another invention disclosed is based on the design of an impedance characterization-monitoring scheme. We disclose a dynamic stimuli waveform engine. In one embodiment of this invention, we present an electrode architecture integrated into or attached to the surface of a typical lockbox or safe, magazine or other physical area and configured in such a way as to ensure that the shock path is delivered to a set of electrodes which are spaced to discharge the energy in a space less than the width of a child's finger pad under a load whereby the finger tips are being depressed and thus deformed to their largest circumference. We begin with the electrode spacing of 0.8 mm between, thus ensuring the stimuli can be delivered to a highly controlled body region. Using this approach, we can limit the shock path to one hand, or other part of the body that can come into contact with the electrode area without the shock path traveling through the torso or across the body thereby eliminating the potential for cardiac signal contamination.

This is accomplished using a set of closely spaced electrodes, so close in fact, that that it becomes impossible to make any contact without contacting both the positive and negative electrodes which ensures a localized discharge of the energy. This needs to be true if the system were touched with one hand, two hands or with the either hand while the feet or other part of the body is grounded. As an example and assuming the individual used their hand to touch the protected area, a countermeasure payload would be deployed to deter by discharging electrical stimuli to the following regions including the: The long flexors and extensors, the Thenar eminence group, the Hypothenar eminence group, Interosseous muscles group, the Flexor digitorum profundus and the Lumbricals of the hand to achieve this goal the system contemplates the breakdown voltage of the isolating material (in the case of the first implementation this was air but any non-conducting material will work). Air breaks down at about 30 KV/inch or 300 v/0.01 in. The proposed system generates 370 v at a 0.01 amp requiring the electrodes to be spaced a minimum of 0.0125 in apart to prevent unwanted breakdown without human contact and considers an individual to have a resistance of 1000-1500 ohms. Air is used only as an example. Other isolating materials might be plastics or other dielectric, including but not limited to ABS, PLA or other common insulating materials. However, since the electrodes must be exposed to the touch, the gaps in air will always be a factor.

To ensure the reliable system functionality and keep a proximity that will ensure full contact within the width of a human finger, a distance of 0.03125" was selected as a starting point. The electrode configuration may be any form factor from interlocking pins of opposite polarity to a mesh woven of opposite polarity wires embedded into the housing itself or other surface The electrodes can be constructed out of any conductive material including but not limited to gold, nickel, silver, steel, conductive threads, carbon or carbon fiber.

The next step taken to ensure safety exploits the impedance of a human being. Beginning with characterizing the impedance of the safe in its operating environment (or other items in the safe zone) as to obtain an impedance baseline that is stored. Then the invisible safe is activated, it considers any gross delta in the impedance as contact and engagement with a human has been made. At this time, it can begin to deploy its countermeasures. In the case of electrical shock payload, it delivers a short duration of electrical stimuli lasting no more than (10 ms-50 ms) causing the contraction of the muscles in the fingers and hand. At the conclusion of that event, it stops the production of the electrical stimuli energy monitors through the impedance engine that the finger, hand or other body appendage to uncouple contact from the safe (or other items being monitored). This requires 10 ms-30 ms to body to respond and approximately 60 ms for the contracted muscles to relax. At this point, the individual either removes their hand (50-100 ms), or attempts to touch the safe again (25-50 ms). At all times, the impedance is being monitored, as it the duration of payload. If the hand is still in contact at the conclusion of the completed event, then the electrical shock is delivered again using the same protocol as describe above.

In another embodiment, all of the positive and negative electrodes can be individually wired to an array, which can control the discharge of energy through any two or more electrodes concurrently. Each electrode would be separately addressable by a X-Y location. Thus, the electrode array contact area can be adjusted dynamically based on application. Under such a scenario, a user could attempt to use they're other hand to open the safe, while the initial hand is still making contact with the electrodes. The impedance engine measures and determines additional impedance added to the system at the new X-Y location. It could toggle off the initial electrodes, then toggle on the new electrodes of the new location, and continue to toggle between the two. This would mitigate any potential of a shock path crossing the cardiac path.

There are four primary factors effecting the severity of the shock a person receives when he or she is a part of an electrical circuit: In another embodiment, the electrical stimuli engine will timeout based on one or more these threshold events: The amount of current flowing through the body (measured in amperes), path of the current through the body, length of time the body is in the circuit and the voltage of the stimuli.

As an additional safety feature, the electrical stimuli engine delivery the lowest level of energy to the electrodes, and monitors the individual's reaction. If the finger or hand is not removed, then the power level can be increased delivering greater level of energy. The threshold of sensation is only 1 mA and, although unpleasant, shocks are harmless for currents less than 5 mA. At 10 to 20 mA and above, the current can stimulate sustained muscular contractions much as regular nerve impulses.

In another embodiment, the impedance measurements establish the profile of the electrical stimuli to be generated, based on the in situ impedance analysis. The electrical stimuli engine can titrate the electrical stimulus waveform: frequency of stimuli including, the voltage, power level in current, muscle refractory period, duration of total event, duty cycle, changing the X-Y electrode location, which can transfer the electrical stimuli to the target muscle area. Other variables account for is body weight as age are part of the initial setup. In general, higher stimulus energy may be required for older individuals.

The next safety step is to ensure that only a defined electrical stimulus waveform payload be delivered for defined period of time. A FET circuit measures the impedance based on the contact of the skin with the electrodes. It sets up the electrical stimuli payload dynamically. The skin resistance may vary from: the resistance of moist thin skin is about 0.5 kΩ/cm2 vs. the resistance of dry well-keratinized intact skin is 20-30 kΩ/cm2.

The FET engine determines if the electrical stimuli is being experienced on one hand vs. across the cardiac path into the opposite hand. It will immediately stop the release of energy of such as the case. In another embodiment, the FET circuit monitors the impedance during the delivery of the electrical stimuli and terminates the production of the energy if the individual is no longer in contact with the safe or gun, meaning that their hand or fingers (examples) are removed from the metal contact area. If the impedance engine measures a resistance of less than 10 ohms, the electrical stimuli engine times out until the low impedance short is resolved.

In another embodiment, it is forecasted some may attempt to use water, saltwater to or even body fluids (urine) to short out the electrical stimulus, the system will automatically shut down if the resistance drops, as it would when wet. In order to design for the possibility of this use case, the surface area of the safe is treated with a hydrophobic coating technology will repel water on the surface. The same hydrophobic coating technology can be applied to the weapon and or magazine.

In another embodiment, a mat which can be used for the gun to be laid upon, has an IMU or other type of sensor can detect slight movement thus inducing electrical stimulus into the magazine.

The magazine is equipped with an IMU, which can detect slight movement would translate into electrical stimuli engine outputting energy into the magazine or the lockbox finger sensors.

The lockbox can detect the slight movement and manipulation of the lock box itself via an IMU. In another embodiment the IMU can be embedded gun magazine. Movement of the IMU would induce electrical stimulus onto the user's finger or hand.

Safety measures are the top priory, beginning with the power supply. The stimuli engine is current limited not to exceed 10 milliamps, any amperage above that threshold can cause serve muscular contractions and paralysis. A voltage regular circuit is also incorporated as part of the design. If the electrical stimuli engine terminates its payload delivery, a different deterrent such as sound, light, chemical or other can activate. In addition, the system can send notification to the administrator of the events.

In one embodiment, the countermeasure can serve as a warning, which is intended to inform the user that the area or device is being monitored, to a severe countermeasure, which will incapacitate and temporally neutralize the user for minutes or more. In some instances, the individual may be severely depressed, mentally unstable in the case of one who is experiencing suicidal thoughts. The countermeasure must overcome this extreme condition as to save a life. The countermeasure introduces an extreme acoustical threat to the individual and overcomes their current psychological barrier state thus preventing access of the weapon at that time. Countermeasures are designed to deliver various degrees of stimuli either cognitively overloading the individual as to produce: fear, terror, panic, chaos, and pain as to cause trauma with the end goal of inducing a state of psychological saturation, whereby the individual has reached his/her limit and discontinues advancing in their original purpose. Psychological saturation is the threshold whereby one's attention, decision-making, judgment, motivation, perception, reasoning and thinking become dysfunctional. Countermeasures provide for a $2^{nd}$ benefit, as they also leave an imprint on our cellular memory—the experiences our bodies hold. They produce implicit memories, and last for life. Not surprisingly, they support survival. For example, after getting burned on a hot stove, a child will likely steer clear of the stove in order to avoid the harmful heat and pain. Traumatic memories are a kind of conditioned threat response. Memories are biological phenomena and as such are dynamic. Exposure to cues that trigger the recall or retrieval of traumatic memories activates the neural systems that are storing the memories. This includes electrical activation of the neural circuits, as well as underlying intracellular processes. Subsequently, the user is preconditioned not to attempt to access the weapon in the future in fear of reactivation of the traumatic memories induced by the countermeasures.

With respect to adding additional clarity to the attributes of countermeasures, they can take the form of: acoustic, electrical, optical, chemical, thermal, mechanical. These countermeasures can be fixed, mobile, airborne, water-based, and maybe delivered by physical contact such as touch or other routes of administration such as: sound, smell, taste, orally, superficially, subcutaneously, or through the eyes, ears, nose, mouth, through the dermis. Countermeasures can be manifested as an animal, bugs, snakes, spiders, worms, flying bats and microorganisms. Countermeasures can additionally be manifested by physiological stimuli such as, audio recordings, audio sound pressure levels, video recordings, smells, temperature and luminance. Countermeasures can additionally be manifested by human encounters such as with, law enforcement, teacher, friend, loved ones and superiors.

Release of the Countermeasures are deployed conditionally upon an attempt to access the region of interest (in this example) the safe, the firearm, the magazine or any other contents (that are within the virtual-safe meaning that the safe that is created is a space within the digital domain and can be represented within any physical or virtual location) by an unauthorized individual. Countermeasure may be deployed outside the region of interest while be triggered by anyone of the sensors, detectors disclosed in the document.

Countermeasures can be deployed sequentially or in parallel. Countermeasures can be fixed, mobile, airborne or waterborne. Countermeasures can be delivered in a manner whereby they are titrated and increase in dosage and or duration based on need or in response to the users response. Repeated attempts to gain access to the region of interest by an unauthorized individual can redeploy any or all of the following countermeasures: repeat, extend the duration, modify the power level, introduce a different.

The sixth element of the Virtual Safe—is the biometric Interface that is used to authenticate the user and to provide access to the device without any Countermeasures being deployed. The biometric Interface can take the form of voice recognition, facial recognition, Iris recognition, fingerprint recognition, ear print recognition, gait and cadence recognition, ECG ID recognition, or other forms of biometric identifiers including subcutaneous identifiers known as vein detection.

As In the case of vein detection, the authenticating sensor can be mounted in commonly found items that reside in a bedroom or residence as to minimize their visibility. In one embodiment, the vein sensor is embodied and a flexible pad which can reside on the top of the dresser, and the draw, or on top of a physical save. The sensor can use large area Photo detection technology with near IR illumination. In another embodiment, the sensor uses a scanning laser and a micro mirror system to acquire the veins located under the surface of a finger or under the surface of a palm or the vein topology found underneath the dermis in ones face. In another embodiment, the detection of veins can't be located in the region of the human eye.

These additional forms of vein detection in the embodied embody and other physical Devices including a mirror, a mobile phone, apparent glasses, a pair of gloves, the door knob, a bedpost, the furniture cabinet. A user who is authorized on the virtual safe system authenticate themselves using some form of biometric identification as referenced above, and a form of feedback is provided for the user notifying them that authentication is verified. At such time, access to the virtual safe area, weapon, magazine or other accessories would not enable activation of any countermeasures. These countermeasures can take the form of acoustical, electronic shock, optical overload using green lasers at 555 nm, so less power is needed to provoke a temporary disorientation and confusion, even under daylight conditions, chemical, mechanical or other forms of deterrent and countermeasures defined within this document.

Control and Authorization of Access.

Personal identification technology is increasingly becoming important in security systems. The key advantages of using biometric technology are non-repudiation, not guessable, not forgettable and availability. There are significant barriers when attempting biometric identification when individual is experiencing psychological stress under fight or flight situations. There are many biometric modalities such as fingerprint, retina, iris, vein etc. that can be used as biometric identifiers such as Voice ID, Fingerprint ID, Ear Pattern ID, Iris ID, to authenticate individuals, however most will fail to accurately validate ones identity as stress activates the Sympathetic Nervous System (SNS) which influences all physiological factors including voice changes including pitch changes, and level, activation of the sweat glands causing compromised fingerprint detection, heartbeat pattern, known as an electrocardiogram (ECG) the sympathetic nervous system increases heart rate, blood pressure and breathing, the sympathetic nervous system readies the body for action with a massive dose of hormones, such as adrenaline, boosting heart rate, blood pressure and breathing, causes contraction and a decrease in the diameter of the pupil, all of which to lead to unreliable identification.

There are but two biometric modalities, which are not subject to fight or flight SNS physiological influences, fingerprint recognition and palm vein recognition. Both fingerprint and palm vein recognition are physiological modalities which mean they are related to the shape of the body. Fingerprints identification works on the impressions made by a regular texture pattern found on the fingerprints and is composed of ridges and valleys. These ridges are characterized by landmark points known as minutiae and the spatial distribution of these minutiae points is unique to each finger. And, it is the collection of these minutiae points that is primarily used for matching of two fingerprints. This is how Automatic Fingerprint Identification Systems (AFIS) operate. For reasons discussed above as well as the concerns of dirt carried on the skin surface, cuts on the skins surface, bruises which effect the color of the skin, Fingerprint ID in woefully inadequate for an authentication system which requires extremely fast and reliable detection.

The other kind of biometric trait, palm vein technology uses an infrared sensor, which is used to identify an individual's vein pattern. Palm vein identification is an ideal modality for the extreme requirements and robustness of an authentication needed for operational integrity of the invention disclosed. Palm vein is a type of vascular pattern authentication. It works by comparing the pattern of veins in the palm of the person being authenticated with the pattern stored in a database. It uses an infrared beam to penetrate the person's hand as it is held over the sensor. These vein patterns appear as blue lines and are unique to each individual. According to research, even identical twins have distinct patterns, which contributes to the high accuracy rates of palm vein technology. In another study 140000 palms were compared, TFA—False Acceptance Rate is less than 0.00008%. The vascular patterns exist inside the body and consequently they cannot be stolen by means of photography, voice recording or tracing. Hence forgery is extremely difficult under ordinary conditions, which make this method of biometric authentication more secure than others. It is also immune to cuts, bruises, dirt, lotions or sweat as the patterns are located under the skin (Dermis).

The veins present in the palm can be easily acquired using near infrared illumination. The deoxidized hemoglobin in the vein vessels absorbs light of wavelength 7.6×10-4 mm within the near-infrared area. When the infrared light illuminates the palm, only the blood vessel pattern containing the deoxidized hemoglobin is captured as a series of dark lines. The authentication device then translates these dark lines of the infrared image as the blood vessel pattern of the palm and matches it with the previously registered pattern of the individual.

We introduce a new method and process for biometric identification. This new authentication engine employs a scanning laser operating at 880-930 nm to extract vein topology, improve image contrast of the palm vein and to extract blood flow pattern for liveness detection as well as acquiring hand geometry as an additional element of the authentication process. A micro mirror reflects a laser beam and performs a uniform raster scan. Further, the laser system incorporates hand geometry to obtain a 3D digitized image without using any hand position restricting mechanism while adding a secondary level of security. Recently, palm vein imaging technology has been under development using the shadow effect of near-infrared light-emitting diodes (NIR LEDs). This method, however, might degrade the image contrast because LED light is not collimated and resultantly spreads out of the palm, which leads to higher background noise. Direct contact of the finger with the LEDs can enhance resolution, but may cause cross-contamination. Meanwhile, the detection of blood flow in the palm vein is very important for liveness detection. LED light cannot provide an accurate image of blood flow because of its short coherence length. The use of point scanning of illumination potentially also allows three-dimensional tomography of vein structures with the time-domain technique.

When in a fight or flight situation, locating your digits (fingers) on a specific fingertip tip sensor is not practical, whereas placing you palm on a large surface area is very straightforward. The laser and micro mirror is embedded in pad or other resource whereby in naturally captures the palm area and hand geometry. The algorithms enable the registration of a user for multiple orientations of your palm.

No ambient light is required to simply place you hand down on a surface or pad. Furthermore; the surface or pad can be manufactured with depressions to guide your palm and fingers.

In another embodiment, the laser assembly can be absorbed inside a door handle, thus naturally placing your palm on the door handle or know can authenticate the user. Haptic feedback is built in to the authentication engine as to provide feedback to the user. As an example, if the users identity is confirmed, the user would experience mechanical vibration in the hand of 0.250 ms, but if the users identity wasn't confirmed as is denied, the feedback may be two 0.1 sec ultra short bursts.

In another embodiment, the authentication engine acquires and stores the palm print and geometry every time an individual attempts to gain access the system. Thus, the system preserves a palm vein and hand geometry record including the records of non-authorized users attempts. During setup or other, the system learns the authorized users vein patterns, hand geometry, enable both left or right palms to be registered as well as multiple users while capturing their photo using the CCD camera, and communicates with their mobile phone to capture text-based info.

In use, the system can transmit all actions encountered by the authentication engine, such that the administrator of system can receive live time coded video feeds to an individual attempting access as their identify if previously registered by the system. This video stream can be preserved locally or in the cloud, for forensic applications. Although the system is blind to the identity of the individual if not stored in its database, it matches the prior attempted vein topology records to determine if the current detected vein topology and hand geometry has attempted access of the authentication engine previously. In addition, the authentication engine maintains a record of the countermeasure deployed of the time of detection.

The system is capable of deploying countermeasures based on set of variables. As such, the system can deploy a different countermeasure from the original as to induce the greatest level of deterrent possible. The added benefit is that the user cannot plan for what they may be exposed to in terms of the countermeasures, as it can be different from the countermeasures, they originally experienced. Furthermore, any or all of the following countermeasures can be redeployed by: repeat, extend the duration, modify the power level.

In another embodiment, hand geometry coupled to palm vein detection enabled by a scanning laser to extract blood flow pattern for liveness detection provides for False Acceptance Rate (FAR) and False Reject Rate (FRR) at the highest confidence levels.

In another embodiment, the scanning laser and near IR light engine can be incorporated into a platform that can be enhanced for other use cases and applications. In addition to the scanning laser, the system can incorporate a Programmable Structured Light (DLP), Fixed Structured Light, and Stereoscopic Vision, and Time of Flight (ToF) sensors, detectors and software. By using two cameras, additional layers of security authentication can be enabled. The users identity can be evaluated either using facial recognition; ear recognition, and finger vein recognition.

AC powered mode, can keep the all the various sensors operating. While in a battery-operated mode, an internal microphone is incorporated to power up the authentication engine using audio such as voice or other noises; the sound of running water or the movement or footsteps. Ultrasonic sensors can also be used to wake up as someone is approaching the system.

In another embodiment, the authentication engine can contain an ultra-low power IMU which powers up the necessary hardware and software when the pad is destined a such as the motion exercised from downward palm pressure or the gripping a knob, Furthermore, it can be powered up when it learns of a cell phone in its range, or by a light being activated in the room or by the interface to the existing security system.

In another embodiment, the system contains AI engine as to learn the audience voices of its installed location and can be powered up or activated when it experiences a voice that its unfamiliar with such as a burglar, or someone else in the room who is not authorized to be there. It can be interfaced with Alexa, Siri or other home control voice achieved platform.

In one embodiment, the authentication engine maybe used for applications where hundreds of users have been credentialed authorized status to the system. This may be for DoD applications, retail applications where firearms are sold, for other applications whereby the system is being used to protect valuable in control products or substances, or accessing a point of entry of a building or facility, vehicle, motor craft, aircraft. The authentication engine can incorporate cameras to document the event. The facial features, clothing, gender, what the individual is carrying at the time they attempt authentication. The system captures these images using CCD cameras in addition to infrared camera technology. Furthermore, the system can incorporate ToF sensors for near field and for field Image acquisition.

In one embodiment, an individual who maybe in the vicinity of the authentication tool, would be detected by a far field flight sensor, which in turn would activate the CCD sensor and record the individual in reveal detailed image. As an individual approaches the authentication platform, the near field ToF detector would alert authorities that someone was attempting access. For low level or no visibility conditions such as maintain stealth, or operating the system at night, the authentication engine contains a near IR vertical-cavity surface-emitting laser (VCSEL) array for the ToF camera.

Multiple ToF sensors may be incorporated providing near and far field image detection. In one embodiment, laser based cameras are mounted in a safe pad. In this configuration, a weapon could be inserted on the pad and the near field camera would extract the features of that weapon regardless of the orientation of the weapons on the pad. Once the authentication engine confirms the detected object is a weapon the system is activated and countermeasures stand ready to protect access of the weapon. In another embodiment, the authentication engine can transmit a signal to a type of ammunition which can be electronically authenticated and can then be fired from a weapon.

Object Detection—Location Discovery—Inventory Management. In another embodiment, there are other objects inserted on the pad such is a set of keys; under this scenario the system would not be activated meaning that a countermeasure would not be enabled.

Another benefit of the system is object detection and location discovery. As a way of locating testing in ones home or business, on mobile phone can interrogate the various pads within the confines of the home or other had determined if keys are present on the safe pad.

In another embodiment pads can contain piezo pressure sensitive contacts or others which determine if the gun or present on the safe pad. In another embodiment the pad could contain multiple photo optical protectors embedded in the pad spaced evenly horizontal and vertical axis. Once a weapon would be committed to the safe pad, regardless of orientation the photo detectors would discern the geometry of the weapon and enable the system.

In another embodiment the near field sensor could be used and applications for inventory control such as the system of counting various bottled geometries maybe use in hotel rooms or liquor in a locked room locked environment. The various bottle geometries are easily discernible on the system good evaluate and report the Location of the quadrants were bottles would have been removed. Video recording of the event when hand is put down or the acquire problem an additional CCD camera built-in to the safe pad.

Once the palm vain censor were activated in less than a few hundred milliseconds the system is able to affirm identity or deny an intruder, report the status acquire a photograph activate countermeasures, communicate in SMS, and unlock the physical safe, in such a brief period of time that, the level of enhanced security is dramatically increased without compromising accessibility to the weapon.

Audio in Response or Mitigation or Intervention (Aka Countermeasures)

When a threat to the facility has been identified, audio may be used for a variety of purposes, including but not limited to communication, alerting, and active intervention to encourage or deter an action or reaction. As described above, the system employs an active policy of incremental intervention, which means that the minimum intervention is deployed, to provide effective intervention results. The initial intervention is dynamically adjusted in order to maximize the likelihood of a successful resolution of the threat, with the minimum intervention. If a threat is not neutralized by, or following, initial intervention, then the intervention is escalated in intensity, quality, duration, location, and so on, as much and as quickly as required to neutralize the threat. The specific context of the deployment will determine the type and attributes of any audio intervention, as well as the timing, duration, and location of deployment.

Nominal Levels of Intervention—The nominal operational mode of the system includes three levels of intervention, labeled solely for the purposes of explanation as "alert", "caution", and "prevent". More or fewer levels of intervention may be identified. The levels of intervention may be identified by any other terms, or no terms. Even if a level of intervention is identified, the system may determine not to deploy that level, depending on the context and the goals of the system at that place and time in the facility. For example, the system may skip the alert and caution levels, and immediately deploy the present level of intervention. Or, alternatively, for example, the system may alert and caution, but ultimately not deploy a prevent intervention. Examples of categories of audio intervention are described below.

Alert Interventions—The system will deploy audio (broadly defined) to provide alerting and notification of threats, events, or status in a facility. Audio alert interventions are intended to provide a general, initial enunciation that the system has detected a threat or event. This may serve to notify individuals in the facility of the occurrence of the event, and of the system identification and categorization of the threat. The alert may also lead directly to an effective reduction or elimination of the threat.

In the case of a facility such as a place of worship examples of the types of events that would be responded to by deploying an audio alert intervention may include, but are not limited to, the entry into the facility by an unauthorized individual; the detection of sound levels that are too loud; the identification of a bullet being chambered; the identification of the spoken phrase, "He's got a gun!"; and so on. In the case of an virtual safe, examples of the types of events that would be responded to by deploying an alert may include, but are not limited to, an individual walking into the bedroom where an virtual safe is configured and active, thereby entering the most distal buffer zone around the protected space.

The specific audio or sounds that are deployed as an alert may depend on the attributes of the event, threat, or status that is being addressed. In one embodiment, the specific type of threat may determine or influence the alert. For example, one type of audio (e.g., a simple "chime") may be deployed when a person enters the building or buffer zone, whereas a different type of audio (e.g., a "ding-ding-ding") may be deployed when a specific spoken phrase is identified. In a second embodiment, the location of the threat may determine or influence the alert. For example, when an individual enters a particular door of the facility, the alert audio may be played near that door. In another embodiment, information about the facility, its status, occupants, or activities may influence the alert sound. For example, if the system determines that the Principal of a school is located in a particular office within the facility, and then when an individual enters the building the resulting alert may be played in the room in which the Principal is located.

In addition to informing individuals about an event or threat, such as is described above, the intention of the alert audio may be to cause behavioral changes immediately, on the part of an individual related to the threat, or to others in the facility. In the case of other individuals in the facility, the alert audio will lead to heightened awareness, attention, alertness, vigilance, or caution. For example, an alert that an individual has entered a school building will cause a person (e.g., a teacher or school police/resource officer) in the building to look towards the door, to assess who is entering. If the situation is on the weekend, when no one else is expected to be entering the school, then others already in the building may exhibit more awareness and caution, may be more prepared to respond to take other actions, if necessary. In the case of an virtual safe in a home, when a child enters the bedroom where the protected space, is configured, the audio alert chime will cause the adults in the rest of the house to be more attentive, and may cause them to immediately go check on why the child is in the bedroom. The audio alert may cause immediate behavioral change on the part of the individual associated with the threat. For example, if an individual enters a building and the system determines that a weapon is present, the audio alert may cause the individual to immediately stop; the audio alert may also cause the individual to remember that he or she forgot to leave his or her weapon in the car; the individual may immediately turn around, exit the facility, and safely store the weapon before returning to the facility. In the case of the virtual safe in the home, when a person enters a room with a protected space, the alert audio may immediately cause the individual to stop; the alert may also enable the individual to recognize or recall that the room is protected, that they are in a buffer zone; and regardless of whether or not the individual understands why the alert audio was deployed, the alert audio may cause the individual to exit the room.

The attributes of the audio used for alerts in this system are carefully designed. The audio signals will be designed for maximum perception, including but not limited to the use of frequencies in the 2000-4000 Hz ranges, which is the range of maximum sensitivity for human hearing. The alert audio is designed to be audible over background sounds: the system is aware of or monitors the current or typical background environmental audio, and ensures that at least one, and typically several, frequency components of the alert audio are above the level of the background sound at that frequency. Well-designed alerts have multiple frequency components that are louder than the background spectrum. The alert audio is also designed to be attention-grabbing, including but not limited to having abrupt onsets for at least one frequency component, by having a mixture of low, medium, and high frequency components, and by having a pulsing or on-off duty cycle that is detectable by the listener.

The alert audio is also designed to provide the appropriate level of emotional or affective response, and/or autonomic activation by the listener. For example, the sound may be designed to be somewhat unpleasant to listen to, or/and may induce a discomfort based on the frequency components, abrupt onsets, pattern, and so on, while perhaps not causing a startling or painful result. The specific attributes of the sound, including but not limited to the frequencies, intensity, location, duration, and pattern, can be adjusted or tuned, either based on a set of rules, or dynamically, to account for the current circumstances. For example, if there is already music playing in the room, the alert audio may be adjusted (e.g., made louder) to ensure the alert is audible and results in the intended intervention effect. Such adjustments may depend on other information, for example whether the individual is a child or an adult, the speed of movement of the individual, or the time of day.

Classes of Audio in Alert Interventions

The alert audio may involve non-speech or spoken audio. The non-speech audio may be organic (naturally occurring), engineered (artificial, human-made), algorithmic, composed, random, or any other type of non-human speech audio. The audio may be simple or complex, with one or more frequency components. Frequency components may be audible (i.e., in the range of human hearing via the typical air-conducted hearing pathways), or sub- or super-audible (i.e., perceptible but via a pathway that is not the typical air-conduction hearing, such as vibrations or ultrasound). Frequency components may be defined or may be variable, and may be random. Noise (i.e., audio with some random frequency components) of all types (e.g., white noise, pink noise, or brown noise) may be used as part or all of an alert audio intervention. The audio may have any amplitude envelope, meaning that the pattern of increasing (also known as "attack"), decay, sustain, or release of the sound may be of any sort. The audio may be a single "pulse" or "burst", or may have a pattern of components, with any tempo, pattern, rhythm, or repetition. Any pattern may be fixed, variable, algorithmically determined, or random. Any attributes of the audio may be fixed or variable, including dynamically tuned based on the situation. Spoken audio may include natural or artificially generated speech, including words, phrases, sentences, and longer. Human-produced or human-like sounds that are similar to speech (collectively called speech-like sounds) such as grunts, yells, coughs, sneezes and other bodily noises may also be used. All attributes of the speech or speech-like sounds may be adjusted or changed, including dynamically, depending on the circumstances. The apparent gender of the sounds may be male, female, or other, and may depend on the circumstances. The identity of the speaker (e.g., the voice of a child's mother) may be adjusted or changed, depending on the circumstances. The contents of the speech or speech-like sounds (i.e., the words that are spoken) may include any message, or no intelligible message, and may be in any or no recognizable language. The contents and/or language may be dynamically adjusted depending on the circumstances. Speech may be presented at any rate or rates, and may be sped up even to the point of no longer being intelligible as speech (i.e., using the class of audio signals known as "spearcons").

In one of many possible embodiments, the alert audio is a single 400 Hz chirp with a moderate rise time of 50 ms and a duration of 200 ms, played at 75 dB SPL. This is a simple audio stimulus that is played once when, in this embodiment, a child enters a parents' bedroom. The alert audio is designed so as not to produce a startle, with a rise time that is not sudden. The audio in this embodiment is audible above the typical or likely background audio, but not so loud as to produce any physiological reaction, other than a general attending response.

In another embodiment, the alert audio is a pattern sounds composed by playing a pre-recorded buzz or "raspberry" sound three times in rapid succession. In this embodiment, the "raspberry" sound is composed of a triangle wave played at 20 dB above the current A-weighted background noise level. In this embodiment, the alert is played from multiple speakers in the area inside a facility entrance, in response to the entry of an individual determined to be carrying a potentially suspicious package. In this embodiment, the alert conveys more urgency than the alert described previously, due to the louder intensity, more complex and higher frequency components, a more rapid onset, and more repetitions. Conveying urgency via the design of the alert sound enables more effective priming of subsequent responses on the part of those who hear the alert.

In another embodiment, the frequency and temporal attributes of the alert audio depend on the nature of the event that is being indicated. In this embodiment, an unknown but non-suspicious individual entering the school is indicated by the chirp sound previously described, played twice with a 500 ms silence between the repetitions, at 15 dB above the background noise level, at each of the locations where the sound is played. In this embodiment the alert is played throughout the school. In this embodiment, there are two variations of the alert: in one variation the first chirp is played at 250 Hz, and the second chirp is played at 300 Hz; in the second variation the first chirp is played at 300 Hz and the second is played at 250 Hz. In this embodiment, the pattern with the rising frequency pattern is played when the unknown individual enters through the front door of the school. The alert with the descending frequency pattern is played when the individual enters via the rear door of the school. Thus, the location of the event is encoded into the alert audio using non-speech sounds, in a simple and easily learned manner.

In a related other embodiment, the sounds for an unknown individual entering are designed as described previously, whereas the sound used as an alert for when a suspicious individual enters is a unique and more urgent "whoop" sound (rising a pitch sweep) played three times. In this embodiment, the alert audio also appends a spoken component (female voice) saying the word "front" or "rear" depending on the entrance door (i.e., resulting in "whoop-whoop—front"). In this embodiment, a more urgent or potentially threatening situation is alerted using a distinct, and more urgent audio pattern. Thus, the category, urgency, and location (among other information) can all be encoded into the alert audio. In a related other embodiment, the whoop-whoop sound is followed by a spoken word indicating the type of threat, such as "gun" (i.e., resulting in "whoop-whoop—gun").

Multiple Audio Alerts

One or more audio alerts may be deployed in response to a single detected event or threat. Any alert audio associated with an event or threat may be deployed at any time and at any location. Multiple alert audio signals may be deployed in response to an event or threat, and may be the same, similar, or different, in terms of audio attributes, time, and/or location. For example, a sharp "ding-ding-ding" sound may play immediately in the bedroom when a child enters, and three seconds later the spoken word "bedroom" is played in the living room where the parents are located. Any attributes (including the actual audio, and the location) of the multiple alert audio signals may be the same, different, or dynamically adjusted. For example, the bedroom-entry "ding" may repeat, may be abrupt and adjusted to be slightly startling to the child; whereas the living room alert is whispered near the location of the parent.

Caution Interventions—Audio interventions that are intended to cause behavioral change, but not necessarily impose consequences, may be described as "cautions". The intent of the caution is to go beyond the alert intervention, and is typically, those not required to be, deployed after an alert intervention. As was described for alert audio signals, caution audio may involve any combination of speech or non-speech audio; may be static or dynamic; may be solitary or repeated; may be single or multiple; may be in one or multiple locations; and so on. As was described for alert audio, caution audio is carefully designed to result in a specific outcome, typically a behavioral change and awareness or knowledge change; and may be adjusted depending on the circumstances.

The attributes of caution audio are typically louder, include more high-frequency components, are more intrusive, more abrupt, more startling, and more adverse. In order to cause a change in knowledge and/or behavior, cautions are more likely to, but are not required to, include speech or speech-like sounds. Caution audio can be directive, in that it causes the listener to behave in a certain way, move in a certain direction, or perform a certain type of action. For example, an audio caution may use a stern, loudly spoken message such as "Get out!" or "Step back!" to cause a specific behavior. An audio caution signal may also be or include a noxious stimulus that serves as a direct consequence, and may serve as a preview of subsequent consequences. For example, a caution audio may include a brief but very loud sound (e.g., 250 ms duration, 120 dB loud), that leads to a direct startle response, considerable discomfort, and potentially some disorientation and confusion. The caution audio is intended to make it clear that non-compliance (e.g., continuing to move toward a protected space, despite being told, "Step Back!") will have severe consequences, but is not intended to be a final consequence for non-compliance.

In one of many possible embodiments, the caution audio contains the spoken phrase, "Step Back!", spoken by a male voice with an urgent, emphatic tone, presented at 100 dB SPL, and in this embodiment is played via loudspeakers that are between 1-5 meters away from the targeted individual, located directly ahead of the individual in their direction of current travel. In this embodiment the phrase is played repeatedly, with 5 seconds between repetitions, until the individual stops advancing, and moves back in the direction from which he or she came.

In another embodiment, the "Step Back" caution audio described above is deployed near the target individual, followed after 500 ms by a brief but loud (250 ms duration, 120 dB SPL intensity) noise pulse. In this embodiment, at the same time a second caution audio composed of a pair of buzz sounds is played in all occupied classrooms, at a level of 15 dB above the ambient sound levels in that classroom. This in-class non-speech caution audio is interpreted by the teachers as code for "Lock down, shelter in place", without immediately conveying any specific issue to the students. In this embodiment, a third simultaneous caution audio involving the buzz-buzz sound plus a spoken command to "Respond Hot!" is played via the school resource/police officer's radio. In this embodiment, this three-part caution is intended to result in different behaviors by three different groups of recipients: the suspicious individual, the classroom teachers, and the police officer.

Multiple Audio Caution Signals

One or more audio caution signals may be deployed in response to an event or threat. When multiple cautions are deployed, they may be the same, similar, or different in terms of the attributes of the audio, as well as location and time. For example, one audio caution signal deployed in response to the identification of an unrecognized individual pointing a gun in a school may involve a spoken command ("Stop! Put down the gun!"), accompanied by a brief but loud disruptive noise burst, directed via multiple speakers specifically at the location of the individual. At the same time, and in response to the same event, the system may deploy repeating, non-speech klaxon sounds throughout the school, which students and staff have learned to interpret as signifying an active shooter situation. The system may, for example, also deploy a third audio caution signal at the location of the school resource officer, with urgent directions of where and how to respond to the threat.

Audio "Prevent" Type Interventions (Countermeasures)—If a threat requires a response more effective than a Caution, the system will deploy a more extreme, noxious, adverse audio intervention, which can be considered a "Prevent" intervention (also described as a countermeasure). A Prevent intervention is a nonlethal response designed to prevent the threat from materializing. The prevent audio is designed to have extreme and debilitating effects. Prevent audio signals are typically extremely loud (e.g., greater than 140 dB SPL), may be of longer duration, may be focused from multiple sources, and contain a set of frequency components that combine to produce extreme discomfort. The exact design of the Prevent audio signal depends on the circumstances, including the potential negative outcome ("cost") of the threat being materialized. The Prevent audio is capable of causing a motivated perpetrator to immediately stop advancing and/or to flee the location. Prevent audio may also cause pain and agony, as well as confusion and fear. The extreme noxious nature of the Prevent audio can lead to emotional reaction, which in turn can lead to the formation of stronger, more durable memories of the noxious event. This, in turn, reduces the likelihood of the individual returning to the location, or repeating the action, that resulted in the Prevent audio stimulus.

In one embodiment, the Prevent audio stimulus is generated by an array of six piezo-electric vibrating elements, each of which generates a sound. In this embodiment, each piezo element is used to output its maximum intensity sound, approximately 125 dB SPL. The array of elements is set to generate sounds of the same frequency, all in phase, with the resulting sound having an effective total intensity of 140 dB SPL or more. The threshold for pain caused by a loud sound depends on the frequency of the sound, and the age and hearing attributes of the listener, but is generally in the range of 120-140 dB SPL. Thus, in this embodiment, the stimulus is loud enough to cause considerable pain to the individual, leading to an immediate flight response, resulting in the individual refraining from the proscribed action. Thus, the prevent audio stimulus is effective due to its extreme intensity. In this embodiment, the frequency of the sound that is generated is set to a single frequency of 4000 Hz, which at very loud intensity levels is the frequency at which the human auditory system is most sensitive (see Fletcher-Munsen curve or ISO 226-2003), which has the effect of maximizing both the perceived loudness, and the perceived pain of the Prevent audio stimulus. The perceived pitch of 4000 Hz is relatively high, corresponding to one of the highest notes on the standard piano. Thus, in this embodiment the painful sound is also extremely annoying, given the unusually high pitch. This adds to the aversive nature of the sound, enhancing the desire for the individual to flee the area. In this embodiment, the duration of the Prevent audio pulse is constant at maximum amplitude for the entire time that the individual is considered a threat (e.g., while they are touching the enclosure/box that surrounds the protected space).

In another embodiment, the sounds are generated by a Long Range Acoustic Device (LRAD), which transmits acoustic energy at 2.5 kHz in a focused beam, over long distances (up to tens of meters or more). In some implementations, the sound energy from an LRAD is focused by using a coherent ultrasound carrier wave, which interacts with the molecules in the air to produce local acoustic waves (sounds). In this embodiment, the sound is not transmitted in all directions, but rather is concentrated in one small region of space. As such, the Prevent sound is pointed at the target individual, with great effect; whereas the audio has little or no collateral effect on non-targeted individuals. LRAD devices are used effectively for crowd control and denial of entry actions. The devices can also be used for less-intense audio production, communication, and hailing, which enables the devices to produce all of the types of audio interventions identified in this system.

In another embodiment, multiple LRAD devices are utilized together. The devices are placed at different locations (one mounted to the ceiling, and one mounted to the wall, 3 meters apart, in this embodiment). The System very rapidly determines the location of the target individual using, in this embodiment, stereo computer vision, laser range finders, and time of flight detectors; and then coordinates the aiming on the LRAD devices to the output audio beams of the two devices coincide at the target, leading to an even more impactful Prevent audio signal. In this embodiment, the two LRAD devices can also operate independently, either generating Prevent audio to two different locations, simultaneously; or deploying different kinds of audio signals (in this embodiment, Prevent audio directed at a target individual, and Caution audio directed at non-target individuals located elsewhere in the space).

In another embodiment, a combination of different audio-generating devices is employed. In this embodiment, a set of powerful loudspeakers, an array of piezo-electric elements, and one or more miniaturized LRAD units are all coordinated to produce prevent audio of massive intensity at one or more locations in the space at or near the protected space. The combination of hardware types allows for different kinds of acoustic signals (in this embodiment, infrasound, sound, and ultrasound) all to be produced simultaneously, at one or more locations and a one or more times. The combination of sound types allows the overall composite sound to be both focused and diffuse; include very low, medium and very high frequencies generated by specialized emitters; and include single or multiple frequency components, play complex audio signals (e.g., recorded speech); and be turned on or off separately.

In another embodiment, the prevent audio signal is composed of multiple frequencies. In this embodiment, the frequency components include 4000, 1050, and 1040 Hz. The frequency components in the stimulus in this embodiment were chosen for several specific outcomes. First, the frequencies are all highly perceptible, close to the peak perception range. This makes each component of the sound very loud. Further, since sound energy is distributed across multiple "critical bands" within the human auditory system, the power of the frequency components will add, thereby increasing the perceived loudness of the sound. Further, in this embodiment two of the frequency components are close in frequency. The 10 Hz frequency separation will lead to acoustic "beating", which is a periodic warble or increase and decrease in intensity of the overall acoustic signal. In this embodiment the beating will occur at the difference between the frequency components, namely 10 Hz, which is slow enough to be detected by human listeners, and also fast enough to cause an additional unpleasantness in the sound, due to the buzzing aspect of the sound. Other embodiments utilize different specific frequency components.

In another embodiment, many frequency components are deployed in the audio signal, resulting in a "noise" signal. In this embodiment, the intensity of the frequency components is approximately equal, with some random fluctuations, resulting in "white noise". The intense white noise signal is highly adversity, and disrupts communication, as well as thoughts, on the part of the targeted individual. The power of the audio is summed across all the critical bands (not just a few), which leads to the audio being perceived as extremely loud and very disruptive. In other similar embodiments other types of audio noise (e.g., "pink" or "Brown" or notched noise) are used. In those cases, the intense noise signal can be used to disrupt the individual, as with white noise; however, the specific frequency design of the noise can allow other signals to be perceived. In one such embodiment, there is a frequency notch in the noise (a small range of frequencies at which there is little or no energy). The Prevent audio noise is still extremely loud; however, if a secondary audio signal, in this embodiment a spoken command to drop the weapon, needs to be played, that secondary audio signal is deployed in the frequency notch in the noise. This enables the spoken command to be heard over the noise, without having to reduce the noise intensity from its initial level.

In another embodiment, the prevent audio signal contains low frequency (infrasound) components, specifically at 19 Hz in this embodiment. Low-frequency acoustic energy, at high intensities, can cause pressure waves that wrap around the human body and cause unusual and disconcerting non-hearing effects on the individual. Different low frequencies will result in resonance in different parts of the body, and therefore different (but still disconcerting) perceptual and physiological phenomena. For example, if the lungs resonate, the individual can experience the feeling of breathlessness. In the present embodiment, the 19 Hz infrasound corresponds to the resonant frequency of the human eyeball; thus, when the prevent audio is presented at high intensities (120 dB or more, and especially at the 130+dB levels), the eyeballs of the targeted individual begin to resonate. This leads to the stimulation of the retina by direct vibration, and causes the individual to see visual spots, flashes, or "ghost" images. This visual effect is highly disorienting and disconcerting, and results in immediate flight response. The individual is highly unlikely to continue the proscribed actions, and is likely to develop and maintain a profound, highly relevant, and adverse memory of the incident. Other embodiments utilize infrasound of different frequencies and intensities to produce different or additional non-hearing results, including but not limited to breathing irregularities, abdominal discomfort, and balance disruptions.

In another embodiment, the Prevent audio signal includes high frequency components, specifically at 16 kHz in this embodiment. The frequency employed in this signal is less-audible or inaudible to some individuals, particularly adults over the age of 30 years who typically exhibit age-relate high-frequency hearing loss. In this embodiment, the Prevent audio signal is audible and aversive to young individuals, such as toddlers, children, and young adults, but is not perceived by adults. This makes for a binary stimulus (effective against children, but ineffective against adults), which is deployed, in this embodiment, in home applications where the intention is to prevent a child from approaching or accessing a gun that is located in the parents' bedroom. The child hears and is deterred by, the ultrasound, whereas the parent is not affected (or is less affected). Thus, if the parent is required to enter the bedroom (in this embodiment) to interact with (intervene with) the child, the Prevent audio that is debilitating to the child does not impact the parent (or other responding adult). In this embodiment the frequency of the high-frequency audio is fixed. In other embodiments the frequency of the audio is adjusted in advance, depending on the measured perceptual capabilities of the potential occupants of the facility. In one such embodiment, the adults' threshold of auditory perception (the frequency at which the adults can no longer hear audio signals) is measured, and that frequency is used as the low end of the frequency range for Prevent audio signals. In another related embodiment, multiple frequency components are included in the Prevent signal, with one or more components in the (lower-frequency) range that is audible to both the adults and children, and one or more components are in the (high-frequency) range that is audible only to the child(ren). In this embodiment the high-frequency components are of high intensity and highly aversive, whereas the low-frequency components are less intense and less aversive. This prevent audio signal in this embodiment is thus audible but not disruptive or debilitating to adults whereas the signal is highly impactful for younger individuals.

In another embodiment, the prevent audio signal includes very high frequency (ultrasound) components, specifically at 1 MHz in this embodiment. The frequency employed in the signal in this embodiment is in the lower end of the range of ultrasound used in medical imaging. Other embodiments deploy ultrasound at higher or lower frequencies. The ultrasound is deployed from a location close to the individual, such as near the handle of a safe. The intensity of the ultrasound signal is high enough (depending on the distance to the individual) that the individual feels pressure on their body, skin, or hand. This sensation is known as "ultrahaptic"

perception, and can be used to provide distal, non-contact sensation of touching or pressing on the skin. Ultrahaptics has been used to provide feedback to the user of a computer system or a warning to the driver of a car, for example. In the present embodiment, however, intense ultrahaptic ultrasound signals result in a physical push away from a location, which in this embodiment is the handle of a safe. The use of ultrasound for haptic impediment or area denial (pushing the hand or entire body away from a target) is novel in this embodiment. Other embodiments use ultrasonic haptics for guidance of an individual, pushing or nudging him or her in a particular direction. Other embodiments of the system use ultrahaptics to create a barrier or virtual fence, which guides the individual where to walk, or prevents the individual from walking in an undesirable direction, or entering a prohibited area.

The prevent audio signal may be adjusted and or modified, as required, depending on the circumstances, including dynamically. One or more prevent audio signals may be deployed in response to a given event or threat. When more than one Prevent audio intervention is deployed in response to a single threat or event, the audio signals may be the same, similar, or may be different, in terms of audio attributes, location, and time.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A virtual perimeter system enabled with interactive countermeasures to mitigate accessibility of an area or object comprising:

at least one sensor that establishes an electronic virtual border from at least a single point to define a protected space;

digital detection means, in communication with said sensor, for detecting the presence of a human, animal, or object encroaching said electronic virtual border; and countermeasure means, in communication with said digital detection means, for generating a countermeasure configured to impede or thwart movement, behavior or actions of the human, animal or object approaching the protected space, wherein said countermeasure escalates in generating additional forms of countermeasures as well as in intensity, duration, temporal pattern or waveforms of the countermeasures as a threat increases, and the threat increases the closer the human, animal, or object is to the protected space.

2. The virtual perimeter system of claim 1, comprising authentication means, in communication with said digital detection means and said countermeasure means, for determining whether the human, animal or object is authorized for access to the protected space.

3. The virtual perimeter system of claim 2, comprising a countermeasure disabling means, in communication with said countermeasure means and said authentication means, for disabling said countermeasure means when the human, animal or object is authenticated by said authentication means.

4. The virtual perimeter system of claim 1, wherein said countermeasure includes one or more countermeasure modalities configured to modify behavior or produce fear, terror, panic and/or chaos in the human or animal affected, wherein the countermeasure modalities include at least one of acoustic energy, lumen, optical, chemical, thermal energy, mechanical, audible words, radio frequency or electrical energy.

5. The virtual perimeter system of claim 1, wherein said digital detection means detects the presence of the human, animal or object to determine whether the body encroaching said electronic virtual border is human or animal and then said virtual perimeter system modifies said countermeasures accordingly.

6. The virtual perimeter system of claim 5, wherein said countermeasure means is in communication with said digital detection means and after a predetermined period of determining that the encroaching body is human delivers just barely noticeable countermeasure stimulation to the human and gradually increases the intensity of the countermeasure stimulation if the presence continues.

7. The virtual perimeter system of claim 2, wherein said authentication means comprises biometric technology including at least one of facial recognition, gate analysis, voice recognition, iris recognition, ear recognition, fingerprint, palm print or vein detection.

8. The virtual perimeter system of claim 1, wherein said digital detection means is configured to sense contents of the protected space and comprises at least one of time-of-flight (ToF) camera, CCD cameras, LIDAR, RADAR, computer vision engine (CVE) sensor, thermal energy sensor, infrared, hyperspectral camera, laser rangefinder detector, ultrasound sensor, sonar sensor, acoustic sensor or voice recognition technology.

9. The virtual perimeter system of claim 1, further comprising:

at least one sensor in a predetermined object; and an RF transceiver, magnetic transceiver or acoustic transceiver for tracking and determining location and speed of movement, heading, vibration, acceleration or other predetermined parameters of the predetermined object.

10. The virtual perimeter system of claim 1, wherein said at least one sensor creates a protection zone by a set of three-dimensional boundaries.

11. The virtual perimeter system of claim 1 further comprising computer vision, LIDAR, or radar for configuring the protected space with select boundary points, planes and, or radius.

12. The virtual perimeter system of claim 1 wherein said countermeasure means comprises an acoustic transducer array operatively coupled to calibrate the maximum SPL level (sound pressure level) for the protected space or room size.

13. The virtual perimeter system of claim 12 wherein said countermeasure means comprises a DSP circuit (digital signal processor) and hardware configured to monitor the sound pressure level produced by said acoustic transducer.

14. The virtual perimeter system of claim 1 wherein said countermeasure means comprises a vibration energy generator configured to produce and transmit sound pressure.

15. The virtual perimeter system of claim 1 further comprising an inertial measurement unit (MU) for detecting its own movement or magnetic disturbance, said IMU coupled to a power source and transceiver configured to monitor the IMU's location, precise movement, power level, distance moved, speed of movement, activity, axis, zenith, duration, time of event, and reports this information to a receiving circuit that is within range of the RF, MI, or BT broadcast area.

16. The virtual perimeter system of claim 1, further comprising a RFID, Magnetic Induction, Bluetooth or wireless sensor, wherein movement can be determined based on signal strength data.

17. The virtual perimeter system of claim 1, further comprising a computer vision machine configured to use at least one time-of-flight camera incorporating 3D time-of-flight technology.

18. A virtual perimeter system enabled with interactive countermeasures to mitigate accessibility of an area or object comprising:

at least one sensor that establishes an electronic virtual border from at least a single point to define a protected space;

digital detection means, in communication with said sensor, for detecting the presence of a human, animal, or object encroaching said electronic virtual border; and countermeasure means, in communication with said digital detection means, for generating a countermeasure configured to impede or thwart movement, behavior or actions of the human, animal or object approaching the protected space, wherein said digital detection means detects the presence of the human, animal or object to determine whether the body encroaching said electronic virtual border is human or animal and then said virtual perimeter system modifies said countermeasures accordingly, and after a predetermined period of determining that the encroaching body is human delivers barely noticeable countermeasure stimulation to the human and gradually increases the intensity of the countermeasure stimulation if the presence continues.

19. The virtual perimeter system of claim 18, further comprising:

authentication means, in communication with said digital detection means and said countermeasure means, for determining whether the human, animal or object is authorized for access to the protected space.

20. The virtual perimeter system of claim 19, further comprising:

countermeasure disabling means, in communication with said countermeasure means and said authentication means, for disabling said countermeasure means when the human, animal or object is authenticated by said authentication means.

21. The virtual perimeter system of claim 18, wherein said countermeasure escalates in activating additional forms of countermeasures as well as in the intensity, duration, temporal pattern or waveforms of the countermeasures as a threat increases, and the threat increases the closer the human, animal, or object is to the space.

22. The virtual perimeter system of claim 21, wherein said countermeasure includes one or more countermeasure modalities configured to modify behavior or produce fear, terror, panic and/or chaos in the human or animal affected, and the one or more countermeasure modalities include at least one of acoustic energy, lumen, optical, chemical, thermal energy, mechanical, audible words, radio frequency or electrical energy.

23. The virtual perimeter system of claim 19, wherein said authentication means comprises biometric technology including at least one of facial recognition, gate analysis, voice recognition, iris recognition, ear recognition, fingerprint, palm print or vein detection.

24. The virtual perimeter system of claim 18, wherein said digital detection means is configured to sense contents of the protected space and comprises at least one of time-of-flight (ToF) camera, CCD cameras, LIDAR, RADAR, computer vision engine (CVE) sensor, thermal energy sensor, infrared, hyperspectral camera, laser rangefinder detector, ultrasound sensor, sonar sensor, acoustic sensor or voice recognition technology.

25. The virtual perimeter system of claim 18, further comprising:

at least one sensor in a predetermined object; and an RF transceiver, magnetic transceiver or acoustic transceiver for tracking and determining location and speed of movement, heading, vibration, acceleration, or other predetermined parameters of the predetermined object.

26. The virtual perimeter system of claim 18, wherein said at least one sensor creates a protection zone by a set of three-dimensional boundaries.

27. The virtual perimeter system of claim 18 further comprising computer vision, LIDAR, or radar for configuring the protected space with select boundary points, planes and, or radius.

28. The virtual perimeter system of claim 18 wherein said countermeasure means comprises an acoustic transducer array operatively coupled to calibrate the maximum SPL level (sound pressure level) for the protected space or room size.

29. The virtual perimeter system of claim 28 wherein said countermeasure means comprises a DSP circuit (digital signal processor) and hardware configured to monitor the sound pressure level produced by said acoustic transducer.

30. The virtual perimeter system of claim 18 wherein said countermeasure means comprises a vibration energy generator configured to produce and transmit sound pressure.

31. The virtual perimeter system of claim 18 further comprising an inertial measurement unit (IMU) for detecting its own movement or magnetic disturbance, said IMU coupled to a power source and transceiver configured to monitor the IMU's location, precise movement, power level, distance moved, speed of movement, activity, axis, zenith, duration, time of event, and reports this information to a receiving circuit that is within range of the RF, MI, or BT broadcast area.

32. The virtual perimeter system of claim 18, further comprising an RFID, Magnetic Induction, Bluetooth or wireless sensor, wherein movement can be determined based on signal strength data.

33. The virtual perimeter system of claim 18, further comprising a computer vision machine configured to use at least one time-of-flight camera incorporating 3D time-of-flight technology.

34. A virtual perimeter system enabled with interactive countermeasures to mitigate accessibility of an area or object comprising:

at least one sensor that establishes an electronic virtual border from at least a single point to define a protected space;

digital detection means, in communication with said sensor, for detecting the presence of a human, animal, or object encroaching said electronic virtual border;

countermeasure means, in communication with said digital detection means, for generating a countermeasure configured to impede or thwart movement, behavior or actions of the human, animal or object approaching the protected space;

at least one sensor positioned in a predetermined object; and an RF transceiver, magnetic transceiver or acoustic transceiver for tracking and determining location and speed of movement, heading, vibration, acceleration, or other predetermined parameters of the predetermined object.

35. The virtual perimeter system of claim 34, further comprising:

authentication means, in communication with said digital detection means and said countermeasure means, for determining whether the human, animal or object is authorized for access to the protected space.

36. The virtual perimeter system of claim 35, further comprising:

countermeasure disabling means, in communication with said countermeasure means and said authentication means, for disabling said countermeasure means when the human, animal or object is authenticated by said authentication means.

37. The virtual perimeter system of claim 34, wherein said countermeasure escalates in activating additional forms of countermeasures as well as in the intensity, duration, temporal pattern or waveforms of the countermeasures as a threat increases, and the threat increases the closer the human, animal, or object is to the space.

38. The virtual perimeter system of claim 37, wherein said countermeasure includes one or more countermeasure modalities configured to modify behavior or produce fear, terror, panic and/or chaos in the human or animal affected, and the one or more countermeasure modalities include at least one of acoustic energy, lumen, optical, chemical, thermal energy, mechanical, audible words, radio frequency or electrical energy.

39. The virtual perimeter system of claim 34, wherein said digital detection means detects the presence of the human, animal or object to determine whether the body encroaching said electronic virtual border is human or animal and then said virtual perimeter system modifies said countermeasures accordingly.

40. The virtual perimeter system of claim 39, wherein said countermeasure means is in communication with said digital detection means and after a predetermined period of determining that the encroaching body is human delivers barely noticeable electrical stimulation to the human and gradually increases the intensity of the electrical stimulation if the presence continues.

41. The virtual perimeter system of claim 35, wherein said authentication means comprises biometric technology including at least one of facial recognition, gate analysis, voice recognition, iris recognition, ear recognition, fingerprint, palm print or vein detection.

42. The virtual perimeter system of claim 34, wherein said digital detection means is configured to sense contents of the protected space and comprises at least one of time-of-flight (ToF) camera, CCD cameras, LIDAR, RADAR, computer vision engine (CVE) sensor, thermal energy sensor, infrared, hyperspectral camera, laser rangefinder detector, ultrasound sensor, sonar sensor, acoustic sensor or voice recognition technology.

43. The virtual perimeter system of claim 34, wherein said at least one sensor creates a protection zone by a set of three-dimensional boundaries.

44. The virtual perimeter system of claim 34 further comprising computer vision, LIDAR, or radar for configuring the protected space with select boundary points, planes and, or radius.

45. The virtual perimeter system of claim 34 wherein said countermeasure means comprises an acoustic transducer array operatively coupled to calibrate the maximum SPL level (sound pressure level) for the protected space or room size.

46. The virtual perimeter system of claim 45 wherein said countermeasure means comprises a DSP circuit (digital signal processor) and hardware configured to monitor the sound pressure level produced by said acoustic transducer.

47. The virtual perimeter system of claim 34 wherein said countermeasure means comprises a vibration energy generator configured to produce and transmit sound pressure.

48. The virtual perimeter system of claim 34 further comprising an inertial measurement unit (IMU) for detecting its own movement or magnetic disturbance, said IMU coupled to a power source and transceiver configured to monitor the IMU's location, precise movement, power level, distance moved, speed of movement, activity, axis, zenith, duration, time of event, and reports this information to a receiving circuit that is within range of the RF, MI, or BT broadcast area.

49. The virtual perimeter system of claim 34, further comprising an RFID, Magnetic Induction, Bluetooth or wireless sensor, wherein movement can be determined based on signal strength data.

50. The virtual perimeter system of claim 34, further comprising a computer vision machine configured to use at least one time-of-flight camera incorporating 3D time-of-flight technology.

* * * * *